United States Patent [19]

Murata et al.

[11] Patent Number: 4,983,046

[45] Date of Patent: Jan. 8, 1991

[54] MIXER

[75] Inventors: Hiroshi Murata, Kawagoe; Masayuki Yasuguchi, Sagamihara, both of Japan

[73] Assignees: Nisshin Flour Milling Co., Ltd.; Nisshin Engineering Co., Ltd., both of Tokyo, Japan

[21] Appl. No.: 239,210

[22] Filed: Aug. 31, 1988

[30] Foreign Application Priority Data

Sep. 4, 1987 [JP] Japan ..... 62-221248
Sep. 4, 1987 [JP] Japan ..... 62-221249

[51] Int. Cl.[5] ..... B01F 7/28

[52] U.S. Cl. ..... 366/312; 366/314; 366/317; 366/329; 241/199.12

[58] Field of Search ..... 366/225, 309, 312, 315, 366/317, 325, 329, 194, 224, 261, 239, 244, 52, 67, 189, 294, 295, 310, 314, 219, 221, 320, 95, 94, 97–99; 99/348; 422/135, 225; 425/202, 204, 222; 241/199.12, 189 R

[56] References Cited

U.S. PATENT DOCUMENTS

| | | | |
|---|---|---|---|
| 176,775 | 5/1976 | Croft | 366/309 |
| 683,474 | 10/1901 | Mackinzie | 366/309 |
| 823,612 | 6/1906 | Mayfield | 366/309 |
| 936,410 | 10/1909 | Chase et al. | 366/309 |
| 1,673,927 | 6/1928 | Turner | 366/317 |
| 2,481,731 | 9/1949 | Dubin | 366/309 |
| 2,513,254 | 6/1950 | Savage et al. | 366/329 |
| 3,512,569 | 5/1970 | Shen et al. | 366/325 |
| 3,531,092 | 9/1970 | Praschak et al. | 366/279 |
| 3,675,902 | 7/1972 | Marshall . | |
| 3,752,057 | 8/1973 | Groen, Jr. | 366/312 |
| 3,772,434 | 9/1973 | Myers | 366/224 |
| 3,779,531 | 12/1973 | White | 366/317 |
| 3,946,996 | 3/1976 | Gergely | 366/325 |
| 4,153,377 | 5/1979 | Been, Jr. | 366/317 |
| 4,394,981 | 7/1983 | Schold | 366/194 |
| 4,467,080 | 8/1984 | Brun | 422/135 |
| 4,611,922 | 9/1986 | Eirich | 366/224 |

FOREIGN PATENT DOCUMENTS

| | | | |
|---|---|---|---|
| 6409582 | 2/1965 | Netherlands | 366/317 |
| WO88/06000 | of 1988 | PCT Int'l Appl. . | |
| 627384 | of 1949 | United Kingdom . | |
| 890355 | of 1962 | United Kingdom . | |
| 1040968 | of 1963 | United Kingdom . | |
| 2116059 | 9/1983 | United Kingdom | 366/279 |
| 2194460 | of 1988 | United Kingdom . | |

*Primary Examiner*—Harvey C. Hornsby
*Assistant Examiner*—Joseph S. Machuga
*Attorney, Agent, or Firm*—Frishauf, Holtz, Goodman & Woodward

[57] ABSTRACT

A mixer includes an agitating means and a material scraping means in a spherical casing. A mixer further includes a cracking-dispersing means for an easily cohesive powder or an impalpable powder. If crushing of particles need be restricted to a moderate level, the mixer includes either one the above mixers as a mixer main body and an angle setting means for setting the tilt the mixer main body at a given angle.

The above mixers may preferably be used for agitating and mixing a powdery or granular material of all kinds, particle sizes, and specific gravities ranging from an easily cohesive powder or an impalpable powder to particles with which it is preferable to restrict a crushing level.

18 Claims, 8 Drawing Sheets

MIXER

BACKGROUND OF THE INVENTION

1. Field of the Invention

This invention relates to a batch-type mixer for agitating and/or mixing two or more powdered to particulate materials with one another or one or more powdered to particulate materials and a liquid with one another at an elevated speed and occasionally with moderate suppression of the crushing action.

2. Disclosure of the Prior Art

The mixing systems for powdered to particulate materials include a mixed system employing a mixer with a revolving vessel, and a batch- or continuous type mixer with a fixed vessel. For agitating and/or mixing powdered to particulate materials at an elevated speed, a high-speed batch type mixer with a fixed vessel is preferentially employed.

With the high-speed mixer, one or more kinds of powdered to particulate materials to be mixed together are injected in predetermined amounts into a fixed vessel and the agitating blades of various profiles mounted in the vessel are revolved at an elevated speed of the order of 500 to 10,000 rpm to fluidize and agitate the materials compulsorily to effect the mixing. This high speed mixer may be typified by a Henschel mixer, a high-speed mixer or a fine mixer.

It is required of the high speed mixer to elevate the mixing degree. The powdered to particulate materials may be classified into those having finer particle size, referred to hereafter as the powders or fine powders, or powdered or finely powdered materials, and those having coarser particle size, referred to hereafter as the particulate materials. The powdered and finely powdered materials tend to be flocculated and, when they are mixed in the flocculated state, the mixing degree is lowered.

In the above described high-speed mixer, the powders are fluidized and mixed together in the flocculated or lumped stated so that the mixing degree is lowered.

In order to obviate this deficiency, there is proposed a mixer 90, known as the MGT mixer, in which, as shown in FIG. 10, cracking means 92 having multi-stage blades 93 adapted to be revolved at elevated speeds in a box-shaped casing 91 is separately provided at the lateral side of the casing in such a manner that the flocculated powders may be cracked simultaneously during mixing of the powdered to particulate materials.

In this mixer, since the cracking is performed simultaneously with mixing of the powdered to particulate materials, powders X an Y exist in the vicinity of the multi-stage blades of the crushing means, such that the flocculated powders X can not be cracked efficiently. Above all, with the higher mixing ratio of the powders Y, the powders X are less likely to impinge on the multi-stage blades and hence can be cracked only with considerable difficulties.

It becomes therefore necessary to crack the flocculated powders X before mixing the powders X and Y together.

On the other hand, when the powdered to particulate materials are mixed in the above described mixer, some materials undergo changes in the properties indigenous to them due to cracking in the course of mixing. Above all, the particulate materials, such as the granulated sugar having a particle size ranging between about 350 and 800 microns, are crushed by the agitating blades rotating at an elevated speed such that the properties indigenous to the materials are altered.

Although the number of revolutions of the agitating blades can be lowered to the extent that the particulated materials are not crushed in this manner, the mixing speed is then lowered undesirably.

SUMMARY OF THE INVENTION

It is a primary object of the present invention to provide a mixer wherein the above described deficiencies of the prior art may be overcome and the mixing degree may be improved.

It is another object of the present invention to provide a mixer whereby the crushing of the materials, above all the particulate materials, can be suppressed appropriately.

As a result of our eager researches for accomplishing the above objects, the present inventors have found that a mixer wherein cracking and/or dispersing means is provided in the vicinity of the material injection port within the casing for cracking and/or dispersing the materials, above all the powdered materials, and wherein the powdered materials are cracked and dispersed by these cracking and/or dispersing means directly after injection and before mixing of the powdered materials, is highly effective in this respect, and also that the crushing of the materials can be adequately suppressed when the main body of the mixer having the agitator within the casing is tilted at a predetermined angle for performing the agitation and mixing. This finding has led to fulfillment of the present invention.

According to a first aspect of the present invention, there is provided a mixer comprising a casing provided with injection and discharge ports for materials and a spherical inner space, an agitator for agitating and/or mixing the materials injected into said casing through said injection port, and means for scraping off the materials deposited on the inner wall of said casing.

According to a second aspect of the present invention, there is provided a mixer comprising a casing provided with injection and discharge ports for materials and a spherical inner space, cracking and/or dispersing means adapted for cracking and/or dispersing the materials injected at the injection port, an agitator for agitating an/or mixing the cracked and/or dispersed materials, and means for scraping off the materials deposited on the inner wall of said casing.

According to a third aspect of the present invention, there is provided a mixer comprising a main body of the mixer, said main body of the mixer including in turn a casing provided with injection and discharge ports for materials and a spherical inner space, an agitator for agitating and/or mixing the materials injected into said casing through said injection port, and means for scraping off the materials deposited on the inner wall of said casing, and angle setting means for tilting said main body of the mixer at a predetermined angle.

According to a fourth aspect of the present invention, there is provided a mixer comprising a main body of the mixer, said main body of the mixer including in turn a casing provided with injection and discharge ports for materials and a spherical inner space, cracking and/or dispersing means adapted for cracking and/or dispersing the materials injected at the injection port, and means for agitating and mixing the injected materials, and angle setting means for tilting the main body of the mixer at predetermined angle.

In the above various aspects, the agitator is preferably provided with a shaft, agitating blades mounted to said shaft and drive means for driving the shaft into revolutions. The agitating blades are preferably designed as the multi-stage blades.

Preferably, the scraping means include a scraper revolved along the inner wall of the casing and drive means for driving said scraper into revolutions.

Preferably, the scraper is ring-shaped and provided with elastic members contacted with the inner wall of the casing.

Preferably, the shaft and the scraper are installed so as to be revolved concentrically with respect to each other.

In the above second and fourth aspects, the cracking and dispersing means is preferably formed as a rotor provided to the foremost part of the agitator shaft and having a plurality of upstanding projections.

Also, in the above third and fourth aspects, the angle setting means is preferably designed so that the main body of the mixer may be set at a tilt angle of 15 to 60° with respect to the vertical.

DETAILED DESCRIPTION OF THE INVENTION

By referring to the accompanying drawings, certain illustrative embodiments of the mixer of the present invention will be hereafter explained.

Figure 1:
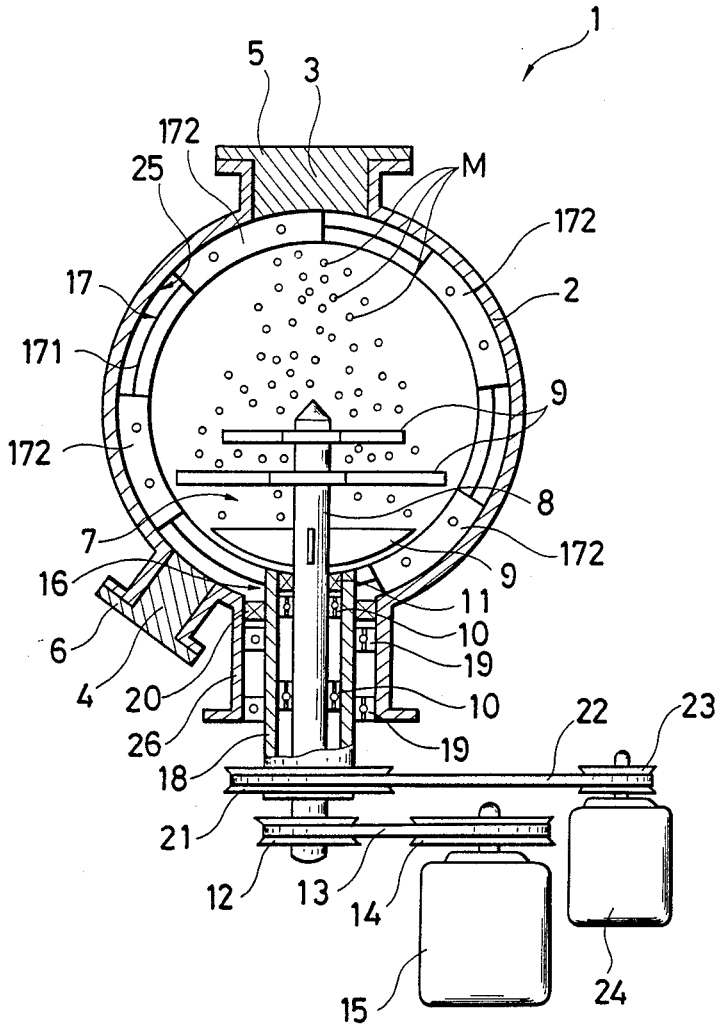
FIG. 1 is a side elevation showing an embodiment of the mixer of the present invention, shown partially in cross-section.

FIG. 1 is a front view of a first embodiment of the mixer of the present invention, shown partially in cross-section.

As shown therein, the mixer 1 has a prescribed capacity necessary for mixing the materials and includes a casing 2, at least the inner spacing of which is spherical. The inner spherical contour of the casing 2 is adopted by the following grounds: First, the superficial area of the inner casing wall may be minimized to procure a predetermined capacity to reduce the amount of the material deposited on the inner wall. Second, the so-called dead zone within the casing 2 may be eliminated to prevent stagnation of the material to elevate the mixing degree. An inlet or injection port 3 for charge or injection of the material and discharge port 4 for discharging the mixed material are provided at the upper and lower portions of the casing 2, respectively. The mixer 1 of the present invention is of the batch type such that the casing 2 need be closed tightly during mixing of the material. For this reason, covers or lids 5 and 6 are mounted to the ports 3 and 4, respectively. These lids are opened and closed at prescribed time points.

The casing 2 is fitted with an agitator 7 for agitating and mixing the materials within the casing and a raker 16 for raking off the material deposited on the inner wall 25 of the casing 2. The construction of the agitator 7 and the raker 16 will now be explained.

The agitator 7 has a shaft 8 projecting a predetermined length into the interior of the casing 2. A plurality of agitating blades, preferably multi-stage blades 9, are secured to the foremost part of the shaft 8 at predetermined intervals from one another.

There is no limitation on the number or the number of stages of the multi-stage agitating blades. The blades 9 may be of any desired planar contour, such as a triangle or rectangle, while they may also be in the flattened plate-like contour or be triangular in cross-section. They may also be bent or distorted in contour if so desired.

The shaft 8 is journaled by bearings 10, 10 within the interior of a hollow shaft 18 which is simultaneously used as the rotary shaft of a scraper 17 to be later described. A pulley 12 is secured to the proximal end of the shaft 8. A belt 13 is placed between the pulley 12 and another pulley 14 secured to a rotary shaft of an electric motor 15 as the drive source for transmitting the rotation of the motor 15 to the shaft 8.

The raker 16 has a hollow shaft 18 the foremost part of which is fitted with the scraper 17 adapted to be revolved along the inner wall of the casing 2.

The scraper 17 is formed by an annular member 171 having an outside diameter slightly less than the inside diameter of the casing 2 and a plurality of elastic members 172 attached at predetermined positions to the annular member 171. When the scraper 17 is revolved, the elastic members 172 are slid in contact with the inner wall 25 of the casing 2 to scrape off the material deposited on the inner wall 25. The elastic members 172 may be arranged relative to the annular member 171 so that, when the scraper makes one complete revolution as shown in FIG. 1, the overall surface of the inner wall 25 of the casing is covered by the elastic members 172. These elastic members are formed of rubber such as urethane rubber or a resin such as Teflon, and are preferably excellent in wear resistance.

The scraper 17 is not limited to the above construction and may for example be designed as a ring member fitted with a brush.

The hollow shaft 18 is journaled by bearings 19, 19 on the inner side of a sleeve 26 provided to the lower portion of the casing 2. A shaft 8 is inserted through the inside of the hollow shaft 18 and journaled by bearings 10, 10 with respect to the hollow shaft 18. In this manner, the shaft 8 of the agitator and the hollow shaft 18 of the scraper are adapted to be revolved concentrically with respect to each other.

With the above construction, the mixer 1 may be reduced in size.

A pulley 21 is secured to the proximal end of the hollow shaft 18 and a belt 22 is placed between the pulley 21 and another pulley 23 secured to a rotor shaft of an electric motor 24 as the drive source to transmit the rotation of the motor 24 to the hollow shaft 18.

Between the upper portion of the sleeve 26 and the hollow shaft 18 and between the foremost part of the hollow shaft 18 and the shaft 8, ring-shaped sealing members 20 and 11 are mounted for preventing leakage of the material within the casing 2. O-rings formed of rubber, V-rings or V-seals likewise formed of rubber or oil seals, for example, may be used as the sealing members 20 and 11.

In the embodiment shown in FIG. 1, the shaft 8 and the hollow shaft 18 are revolved by electric motors 15 and 24. However, both the shafts 8 and 18 may be revolved by one and the same electric motor. Transmission of rotation to the shafts 8 and 18 may also be achieved by motion transmitting means including intermeshing gears, instead of by a belt-pulley drive system.

The shafts 8 and the hollow shaft 18, that is, the agitator blades and the scraper may be revolved in desired directions, however, these shafts are preferably revolved in opposite directions for improving the mixing degree and the shorter mixing time. Furthermore it is more preferable to reverse the revolution directions of the shafts 8 and 18 at a predetermined period of time to get the better mixing degree and the shorter mixing time. It is preferred that the shafts 8 and the hollow shaft 18 be revolved at a higher speed of, for example, 300 to 10,000 rpm and a lower speed of, for example, 10 to 100 rpm, respectively.

The mixer according to the first embodiment of the present invention is basically constructed as described above and able to mix the powdered to particulate materials expeditiously and sufficiently.

Among the materials to be mixed, the powders, especially the fine powders, tend to be flocculated. When the materials are mixed in the flocculated state, the mixing degree is lowered. Thus, according to a second embodiment of the present invention, cracking and/or dispersing means for cracking and/or dispersing the powdered materials is provided in the vicinity of the injection port in the casing. Directly after the injection of the powdered material, The cracking and/or dispersing means operates to crack and/or disperse the flocculated powders, after which the cracked and/or dispersed material is mixed for improving the mixing degree. The cracking/dispersing means may also be provided directly below the injection port when the injection port is provided at the upper portion of the casing.

Figure 2:
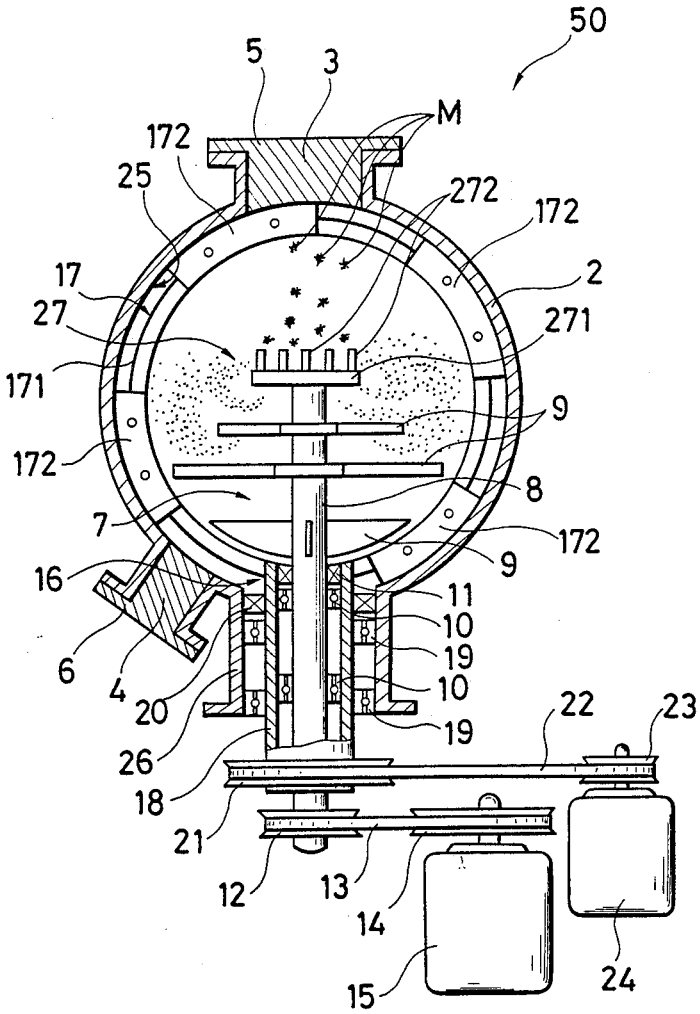
FIG. 2 is side elevation showing an embodiment of the mixer of the present invention having cracking and dispersing means, shown partially in cross-section.

FIG. 2 shows an embodiment of the mixer. According to the second embodiment of the mixer of the present invention, the material injected at the injection port, especially the flocculated powders or fine powders are cracked and/or dispersed.

In the mixer 50 of the second embodiment of the present invention, as shown in FIG. 2, the cracking and/or dispersing means are formed by a rotor 27 fitted to the foremost part of the shaft 8. The mixer 50 shown in FIG. 2 is similar to the mixer of the preceding embodiment except the rotor 27 of the cracking and/or dispersing means. Therefore, the same reference numerals are affixed to the same components and the corresponding description is omitted for simplicity.

Figure 3:
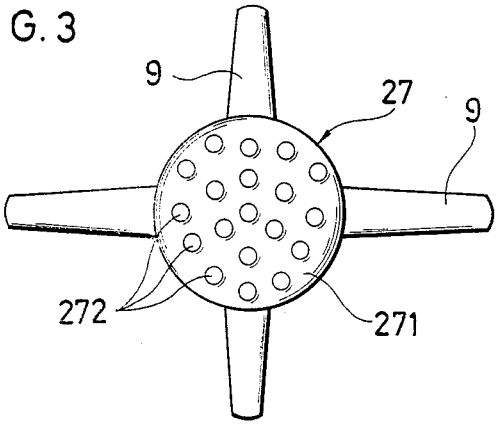
FIG. 3 is a plan view showing an embodiment of the cracking and dispersing means employed in the mixer of the present invention.

As shown in FIG. 3, the rotor 27 of the cracking and/or dispersing means is formed by a disk 271 on which a plurality of upstanding pin-shaped projections 272 are formed. The fine powders injected at the injection port 3 in the flocculated state are impinged on the projections 272 of the rotor 27 revolved at an elevated speed simultaneously with the agitator blades 9 so as to be cracked instantly and be centrifugally dispersed in all directions.

There is no limitation on the shape, number, size, that is, the diameter and the height and the patterns of the projections 272. These may be suitably selected depending on the capacity of the casing or the properties of the injected materials, such as the particle size or the specific gravity, so that the optimum cracking and/or dispersing efficiency will be achieved.

The mixer of the second embodiment of the present invention is constructed basically as described above and able to mix the powders, especially the flocculated powders or fine powders, speedily and sufficiently.

With the use of the above described mixers of the first and second embodiments of the present invention, almost all kinds of powdered to particulate materials may be agitated and mixed. Examples of the powdered to particulate materials include powdered materials such as wheat powders, starch powders, cement, calcium carbonate, alumina or powdered chemicals or particulate materials such as table salt, chemical condiments, iron powders, sand, plastic powders or grains, one of these materials being agitated or two or more of these materials being mixed. The mixer may also be used for mixing the above materials with liquids.

The mixer according to the second embodiment of the present invention is suitable inter alia for agitation and/or mixing the powders or fine powders having a particle size not larger than 10 microns.

It is also suitable for mixing the powdered and particulate materials that may be separated easily from each other or are different in the specific gravity, or for high-speed mixing of trace components of the powdered and particulate materials.

The third and fourth embodiments of the mixer of the present invention will now be explained.

Figure 4:
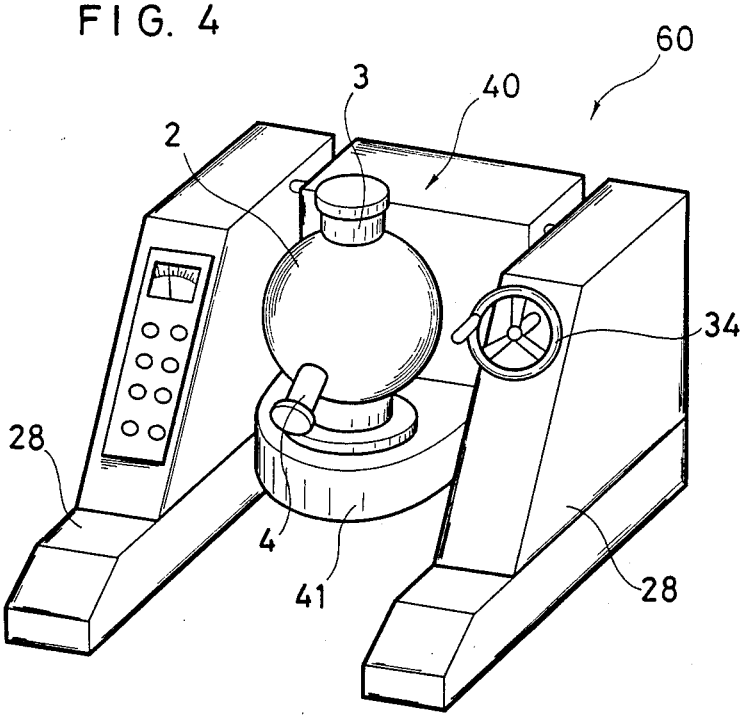
FIG. 4 is a perspective view showing another embodiment of the mixer of the present invention.

FIG. 4 shows an example of the mixer of these embodiments in a perspective view. As shown therein, the mixer 60 is constituted by a main body of the mixer 40 and a supporting base 28 for supporting the main body of the mixer 40. The supporting base 28 is provided with angle setting means for supporting the main body of the mixer 40 at a predetermined angle relative to the vertical direction.

As the main body of the mixer 40, the mixer 1 per se shown in FIG. 1 or the mixer 50 per se shown in FIG. 2 may be employed.

Thus the mixer according to the third embodiment of the present invention has the mixer of the first embodiment per se as the main body of the mixer, whereas the mixer according to the fourth embodiment has the mixer of the second embodiment per se as the main body of the mixer.

Hence, the description of the construction of the main body of the mixer 40 is omitted for simplicity.

In the mixer 60 of the present invention shown in FIG. 4, the main body of the mixer 40 is supported by supporting tables 28, 28 having angle setting means 29 for adjusting the setting angle.

Figure 5:
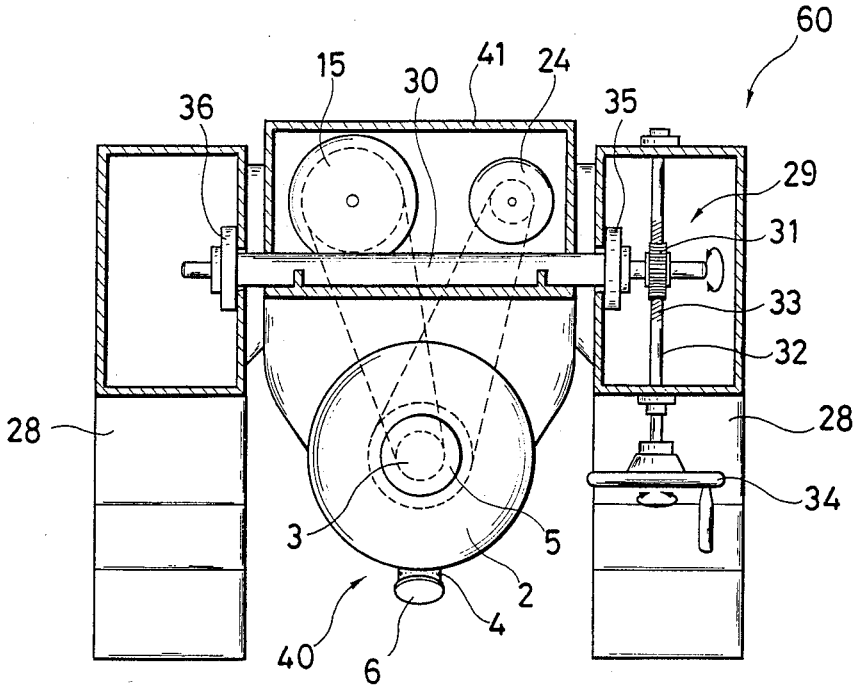
FIG. 5 is a plan view showing the embodiment of FIG. 4, shown partly in section.

As shown in FIGS. 4 and 5, the casing 2 of the main body of the mixer 40 and electric motors 15, 24 are supported and secured to a tilt table 41. At the upper portion of the tilt table 41, a shaft 30 is secured for supporting the tilt table 41 on the supporting tables 28, 28. The shaft 30 has its both ends rotatably supported by bearings 35, 36 on the supporting tables 28, 28.

As shown towards right in FIG. 5, a shaft 32 extending orthogonally to the shaft 30 is mounted for rotation with respect to the supporting table 28. To one and of the shaft 32 is mounted a handle 34 by which to turn the shaft 32.

A worm gear 33 is formed on the shaft 32 and a gear 31 meshing with the worm gear 33 is secured to one end of the shaft 30. The handle 34 may be actuated to turn the shaft 32 in the predetermined direction to turn the shaft 30 to cause the tilt table 41 and the main body of the mixer 40 to be tilted at a prescribed angle.

By agitating and mixing the material with the main body of the mixer 40 tilted as described above, crushing of the material, especially the particulate material, may be limited at the moderate or desired extent.

There is no specific limitation on the preset tilt angle of the main body of the mixer 40, which may be properly determined by factors such as the kind or combination of the materials to be agitated and/or mixed or the amount and the properties, especially the particle size of the powdered to particulate material, as well as the operating conditions, such as the rotative velocity (r.p.m.) of the shaft 8. However, there is a preferred range for this angle when the materials to be agitated and mixed include the particulate material.

Figure 6:
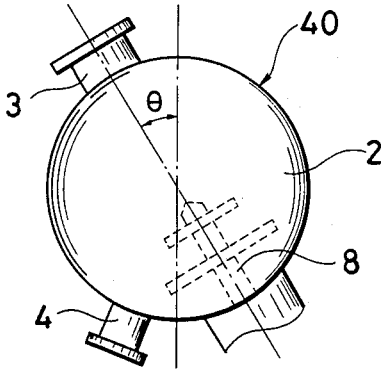
FIG. 6 is a diagrammatic view showing the tilted stated of the main body of the mixer shown in FIG. 4.

Thus the tilt angle of the main body of the mixer 40 is preferably so preset that the angle the main body of the mixer 40 makes with the vertical, that is, the angle $\theta$ (absolute angle) between the vertical and the axis of the shaft 8 as shown in FIG. 6 is in the range of from 15° to 60°. With the angle $\theta$ less than 15°, the effect of limiting the crushing of the particulate material is lowered. On the other hand, with the angle $\theta$ in excess of 60°, uniform mixing can not be always achieved.

Hence, the angle setting means in the present invention need only be designed so that the tilt angle $\theta$ of the main body of the mixer may be set at least within the range of 15° to 60°.

However, should there be presented no crushing inconveniences, the main body of the mixer 40 may be set at an angle other than the above specified angle for performing the agitation and/or mixing. For example, when agitating and/or mixing only the powders or fine powders less prove to crushing, the tilt angle $\theta$ of the main body of the mixer 40 may be set so as to be within range of from 0° to 60° for agitation and/or mixing. If the crushing should be preferentially prevented during the agitation and/or mixing of the particulate material, the agitation and/or the mixing may be performed with the tilt angle $\theta$ being set so as to be in excess of 60°.

The angle setting means in the present invention is not limited to the above described construction wherein the preset tilt angle of the main body of the mixer 40 may be continuously changed, but may include those modified constructions in which the tilt angle may be steplessly changed or fixed to a sole tilt angle. There is similarly no specific limitation on the details of the constructions of the angle setting means.

With the use of the mixer of the present invention, almost all types of the powdered to particulate materials can be agitated and/or mixed in the manner as described above.

The mixers according to the third and fourth embodiments of the present invention are suitable inter alia for agitating and/or mixing readily crushable particulate materials such as those having the particle size in excess of 100 microns.

It is also suitable for mixing the powdered and particulate materials that may be easily separated from each other or two or more powdered to particulate materials having different specific gravities, or for high speed mixing of trace components of two or more powdered materials.

OPERATION

The operation of the mixers of the present invention having the above described basic construction is as follows:

When a material or materials M is to be agitated and/or mixed in the mixer 1 shown in FIG. 1, with the lid 6 of the discharge port 4 first closed, the lid 5 for the inlet or injection port 3 is opened and one or more materials M is charged or injected by way of the port 3. The lid 5 is then closed and the motors 15 and 24 are then driven into rotation, so that the materials in the casing 2 is agitated and/or mixed by the agitator blades 9 rotating at an elevated speed.

When a material including the powdered materials in the flocculated state is to be mixed by the mixer 50 of FIG. 2 fitted with the rotor 27 of the cracking and dispersing means, the mixing is performed after the powders are cracked and dispersed so that the mixing degree is improved.

More in detail, the motors 15 and 24, the agitator 7 and the scraper 17 are driven into operation, and the material M, above all, the powdered material in the flocculated state, is charged into the mixer. This causes the powders to be impinged on the projections 272 of the rotor 27 rotating at an elevated speed and to be cracked instantly to be then dispersed centrifugally in all directions. When the unflocculated particulate material is injected, it is dispersed by the rotor 27. The powdered or particulate material thus cracked and/or dispersed are agitated and/or mixed by the agitating blades 9 rotating at an elevated speed. The powdered material is cracked and dispersed before being mixed so that it can be mixed expeditiously and uniformly.

Although the material tends to become affixed to the inner wall 25 of the casing 2 during mixing, the material thus affixed to the inner wall 25 may be scraped off by the revolving scraper 17 adapted to cover the inner wall in its entirety to prevent stagnation of the material.

The scraper 17 also helps to fluidize the materials to elevate the efficiency of agitation and/or mixing when above all the agitator blades 9 are revolved in the opposite directions.

The spherical inner space of the casing 2 is effective to remove the so-called dead zone in which the material being mixed is allowed to dwell, so that uniform agitation and/or mixing of the materials may be achieved in a shorter time. Above all, the powdered and particulate materials different in particle size or specific gravity may be mixed together uniformly and in a shorter time.

After termination of the agitation and/or mixing of the materials, as described above, the operation of the motors 15 and 24 is stopped, the lid 6 is opened and the agitated and/or mixed materials are taken out at the discharge port 4.

Then, mixers 60 shown in FIG. 4 and 5 may act as follows, wherein they include either the mixer 1 shown in FIG. 1 or the mixer 50 shown in FIG. 2 as a mixer main body, and an angle setting means for setting to tilt the mixer main body at a required angle.

First, the mixer main body is tilted toward a given angle. The handle 34 is manipulated to rotate the shaft 32 toward a desired direction. Then the shaft 30 is rotated by the action of the worm gear 33 formed thereon and the gear 31 meshed therewith to tilt the tilting table 41 and the mixer main body 40 mounted thereon. After the mixer main body has come to an objective angle, the manipulation of the handle 34 is ceased. Thereafter the condition thus set is kept by the action of the worm gear 33. According to the above operation , the tilting angle of the mixer main body 40 is set to a predetermined value.

Then, the agitating and mixing of the material M is performed in the main body 40 of the mixer in a previously described way. In the mixer having the cracking-0 dispersing means, the agitating and mixing is conducted after the cracking-dispersing of the material M. Therefor, the above mixer is effective for materials including an easily cohesive powder or an impalpable powder and an easily crushable granular body, to thereby increase the mixing degree of the material M to admix the material in a satisfactory manner.

As described above, in the mixers 60 shown in FIGS. 4 and 5, the inclination of the mixer main body 40 at a predetermined angle decreases friction among the materials injected, which restricts the crushing degree even in case of materials which consist of or include granular body or bodies.

EXAMPLE

The present invention will now be concretely described with reference to Examples.

EXAMPLE 1

Using a mixer 1 having a construction shown in FIG. 1, a mixing operation of materials shown in the below table 1 was carried out in a batchwise manner under the following conditions.

inner diameter of casing: 200 mm

Agitator agitating blades: three-stage blades

| | |
|---|---|
| diameter of blade: | 120mm<br>150 mm<br>100 mm |

revolution: 6,000 r.p.m.

Scraper: ring of stainless steel (outer diameter 190 mm) fitted at four positions with member of urethane rubber direction of revolution: reverse rotation to agitating blades revolution: 50 r.p.m.

EXAMPLE 2

Using a mixer 50 having a construction shown in FIG. 2, a mixing operation of materials shown in the below table 1 was carried out in a batchwise manner under the similar conditions to Example 1. This mixer was the same as that in Example 1 except cracking-dispersing means shown as follows.

Cracking-Dispersing Means rotor: 33 pins of 10 mm high on the disc having a diameter of 60 mm Reference Using Henschel type mixer as a conventional mixer, materials shown in table 1 were mixed.

Figure 7:
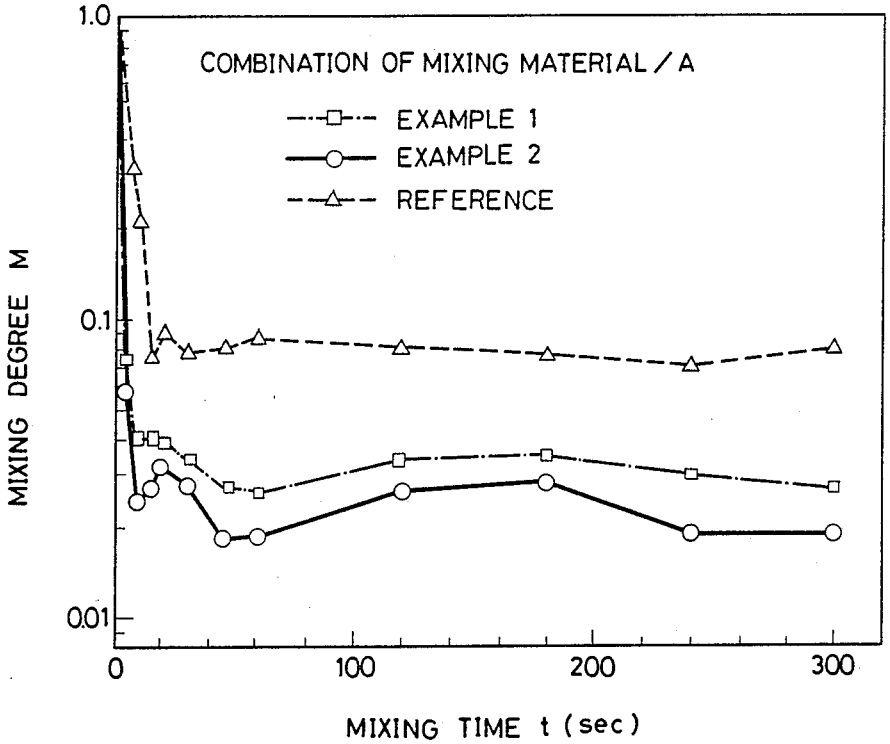
FIGS. 7 and 8 are charts showing the relation between the mixing time and the mixing degree of the mixer of the present invention and the reference mixer.

Using mixers of Examples 1, Example 2 and Reference, materials to be mixed shown in table 1 as combinations A and B were mixed, thereafter change of mixing degree with the passage of time was observed. The results are illustrated in FIG. 7 (with respect to combination A) and FIG. 8 (with respect to combination B).

Combination A indicates an example with both materials to be mixed having approximately equal particle size and different specific gravity, and then combination B is an example with materials to be mixed having different particle size and including an especially easily cohesive alumina powder of an average particle size of 1 μm The mixing degree is calculated in the following equation (1).

$$\text{Mixing Degree } M = \frac{1}{N-1}\sum_{j=1}^{N}\left(\frac{C_j}{C_0} - 1\right)^2 \quad (1)$$

wherein

N is sampling number, $C_j$ is concentration of sample at a predetermined time, and $C_0$ is final concentration (theoretical concentration).

Closer to 0 (zero) mixing degree M means better mixing degree.

Figure 8:
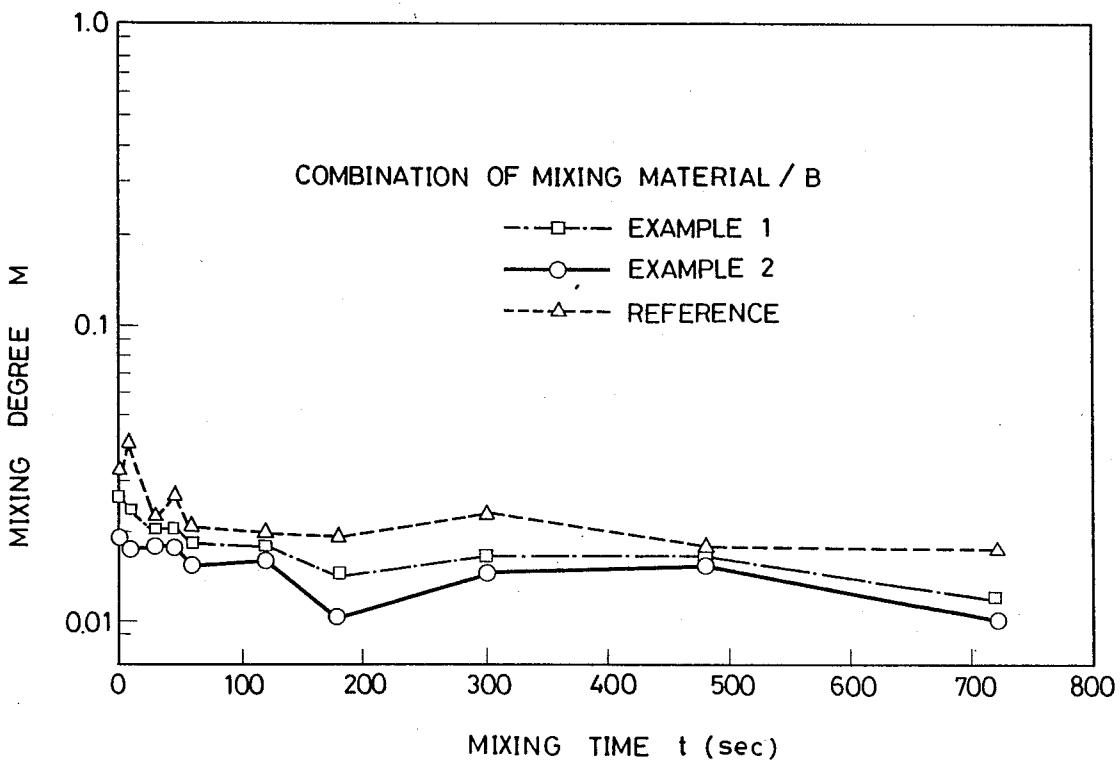

As clearly shown in FIGS. 7 and 8, the mixer of the present invention exhibits a substantial improvement of mixing degree than the conventional mixer.

TABLE 1

| | Material | Average particle size $D_p$ (μm) | Density $\rho_p$ (kg/m$^3$) | Weight ratio of mixing material (wt %) |
|---|---|---|---|---|
| A | Corn Starch | 17.3 | 1450 | 80 |
| | Silicon Carbide SiC #1000 | 18.0 | 3200 | 20 |
| B | Silicon Carbide SiC #320 | 57 | 3200 | 80 |
| | Alumina $Al_2O_3$ #8000 | 1 | 3980 | 20 |

EXAMPLE 3

Using a mixer used in Example 1 as a main body 40 of a mixer 60 shown in FIGS. 4 and 5, materials were mixed in a batchwise manner under the following conditions.

As a material was used granulated sugar ( residue on 350 μm sieve).

In the above mixer, a tilting angle $\theta$ to the perpendicular direction of the main body of the mixer was changed by three stages, $\theta=0°$, $\theta=15°$ and $\theta=30°$, and a change of crushing degree in each material with the passage of time was observed with respect to portions shifted out from 350 μm sieve. The results are shown in a graph of FIG. 9.

Figure 9:
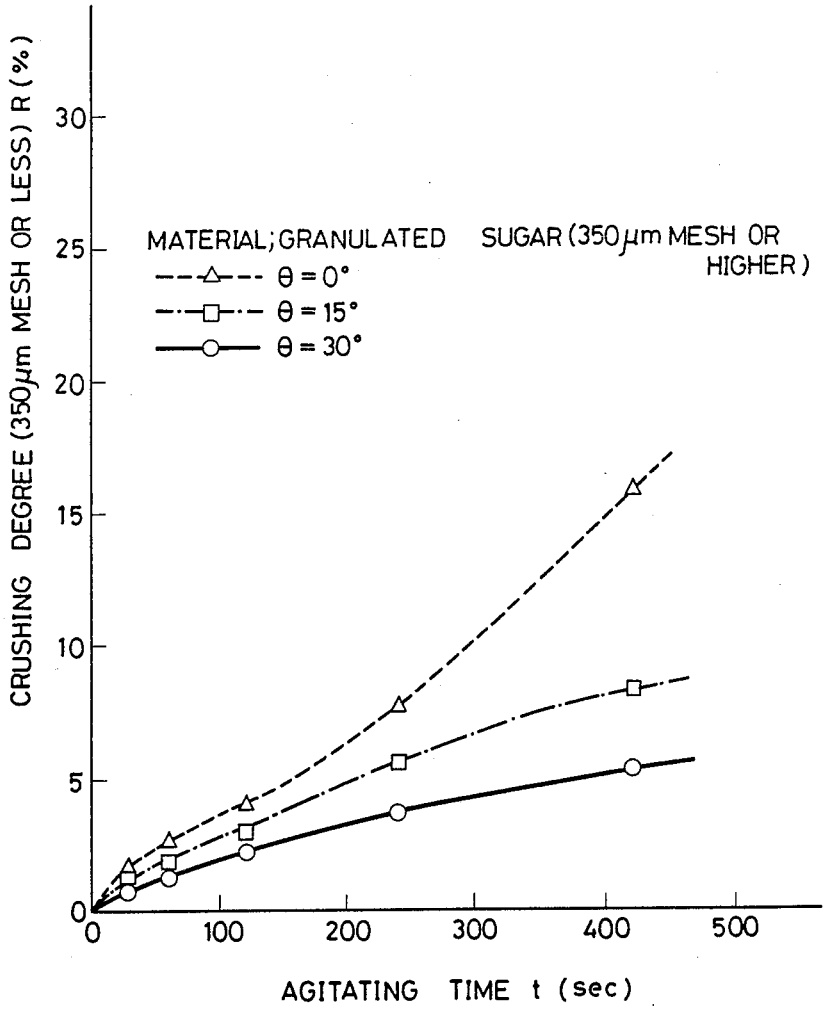
FIG. 9 is a chart showing the relation between the agitation time and the crushing degree of the material.
Figure 10:
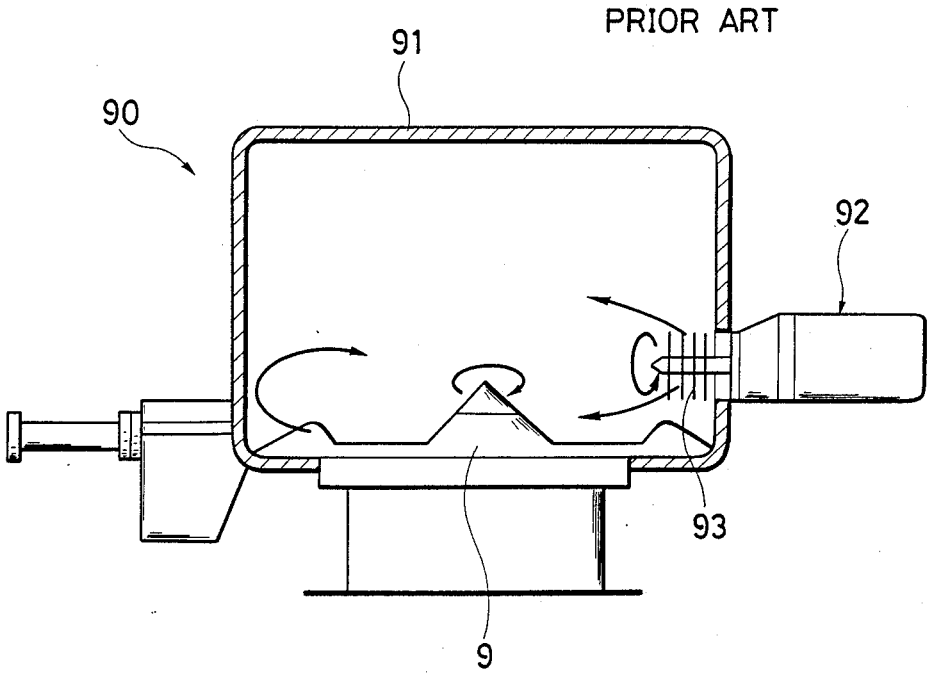
FIG. 10 is a side elevation showing schematically the structure of the conventional mixer or MGT mixer having cracking means, shown partially in cross-section.

As seen from the graph in FIG. 9, it is understood that the agitation and mixing of the material performed under the tilting angles ($\theta=15°$ and 30°) of the mixer main body results in a substantial decrease of the crushing degree.

EXAMPLE 4

The change of the crushing degree R(%) of the material with the passage of time was observed under the same condition, using a mixer similar to that in Example 3 except that the mixer used in Example 2 are used as a mixer main body. The results were obtained similar to that shown in the graph of FIG. 9.

EXAMPLE 5

Using a mixer similar to that in Example 4 with a tilting angle $\theta$ set to 30°, a flocculated alumina powder (average particle size of 1 μm ) and silicon carbide particles ( average particle size of 57 μm ) were mixed. When the materials thus mixed, it was found that alumina powder was substantially cracked and materials were uniformly mixed.

EFFECT OF THE INVENTION

As above-described in detail, according to the present invention, the provision of a casing with a spherical inner wall, a scraper means for scraping materials deposited on the inner wall of the casing and, if necessary, a cracking-dispersing means for cracking and/or dispersing materials injected into the casing ensures a great increase of the mixing degree of materials.

Especially, when an easily cohesive powder or an impalpable powder is mixed, as the mixer of the present invention including a cracking-dispersing means performs cracking and dispersing the powder or the impalpable powder injected in a cohesive manner, followed by mixing, the mixing degree is elevated in comparison with a conventional mixer wherein cracking is simultaneously performed during mixing by a separate cracking means.

In special, the concentrical rotation of a shaft of an agitator and a rotary shaft of a material scraping means, and furthermore a rotary shaft of cracking-dispersing means, if any, enables not only to increase the mixing degree, but also to ensure a compact construction of the mixer itself.

Also, the mixer of the present invention wherein the agitating-mixing operation is performed with a main body of mixer tilt at a predetermined angle by an angle setting means for tilting the mixer main body enables to properly restrict the crushing degree of particles without lowering the mixing degree.

Further, the mixer of the present invention provided with an angle setting means, a cracking-dispersing means for cracking and/or dispersing materials exhibits the effect of cracking-dispersing and mixing a easily cohesive powder or an impalpable powder in case said powder is mixed, and the great effect in case a easily cohesive powder or an impalpable powder and a particle preferable to restrict the crushing are mixed. In each case, the present invention ensures the elevation of the mixing degree in various materials.

As described above, the mixer of the present invention has a high mixing efficiency, so that it may utilize in a wide technical field, for example, for mixing of food powder such as flour, starch etc., mixing of medicaments, mixing of inorganic powder such as ceramics etc., mixing of resin particles.

What is claimed is:

1. A mixer, comprising:

a casing provided with inlet and discharge ports for materials, and a spherical inner space having an inner wall;

agitator means for agitating and mixing materials charged into said casing through said inlet port, said agitator means including a driving shaft, agitator blades mounted one above the other to said shaft, and means for rotatably driving said shaft; and scraping means for scraping off materials deposited on said inner wall of said casing, said scraping means including a scraper revolvable along all of said inner wall of said casing, and means for rotatably driving said scraper at a lower rotational speed than said shaft of said agitator means;

said driving means of said shaft of said agitator means and said driving means of said scraper rotatably revolving said shaft and said scraper concentrically and individually with respect to each other.

2. The mixer of claim 1, wherein said scraper is ring-shaped and includes elastic members adapted for contacting with said inner wall of said casing.

3. A mixer of claim 1, wherein said driving means of said shaft rotates said shaft at a speed of 300 to 10,000 rpm, and said driving means of said scraper rotates said scraper at a speed of 10 to 100 rpm.

4. A mixer, comprising:

a casing provided with inlet and discharge ports for materials, and a spherical inner space having an inner wall;

cracking and dispersing means provided in the vicinity of said inlet port for cracking and dispersing materials charged into said casing at said inlet port before mixing of said materials, agitator means for agitating and mixing the cracked and dispersed materials, said agitator means including a driving shaft having a foremost part, agitator blades mounted one above the other to said shaft, and means for rotatably driving said shaft;

scraping means for scraping off materials deposited on said inner wall of said casing, said scraping means including a scraper revolvable along all of said inner wall of said casing, and means for rotatably driving said scraper at a lower rotational speed than said shaft of said agitator means; and said driving means of said shaft of said agitator means and said driving means of said scraper being independent of each other and rotatably revolving said shaft and said scraper concentrically and individually with respect to each other.

5. The mixer of claim 4, wherein said cracking and dispersing means comprises a rotor mounted to said foremost part of said shaft of said agitator means and having a plurality of upstanding projections.

6. The mixer of claim 4, wherein said scraper is ring-shaped and includes elastic members for contacting with said inner wall of said casing.

7. The mixer of claim 4, wherein said driving means of said shaft rotates said shaft at a speed of 300 to 10,000 rpm, and said driving means of said scraper rotates said scraper at a speed of 10 to 100 rpm.

8. A mixer, comprising:

a mixer main body, said mixer main body including a casing provided with inlet and discharge ports for materials, and a spherical inner space having an inner wall;

agitator means for agitating and mixing materials charged into said casing through said inlet port, said agitator means including a driving shaft, agitator blades mounted one above the other to said shaft, and means for rotatably driving said shaft;

scraping means for scraping off materials deposited on said inner wall of said casing, said scraping means including a scraper revolvable along all of said inner wall of said casing, and means for rotatably driving said scraper, said shaft of said agitator means and said scraper being revolved concentrically and individually with respect to each other; and angle setting means for tilting said main body or said mixer to a predetermined angle to improve mixing of materials in said mixer main body.

9. The mixer of claim 8, wherein said angle setting means includes means for setting said main body of said mixer at a tilt angle of 15 to 60°.

10. The mixer of claim 8, wherein said scraper is ring-shaped and includes elastic members contacting with said inner wall of said casing.

11. The mixer of claim 8, wherein said driving means of said shaft rotates said shaft at a speed of 300 of 10,000 rpm, and said driving means of said scraper means rotates said scraper at a speed of 10 to 100 rpm.

12. A mixer, comprising:

a mixer main body, said mixer main body including a casing provided with inlet and discharge ports for materials and a spherical inner space having an inner wall;

cracking and dispersing means provided in said vicinity of said inlet port for cracking and dispersing materials charged at said inlet port before mixing of said materials;

agitator means for agitating and mixing said charged materials;

scraping means for scraping off materials deposited on said inner wall of said casing, said scraping means including a scraper revolvable along all of said inner wall of said casing, and means for rotatably driving said scraper; and angle setting means for tilting said main body of said mixer to a predetermined angle to improve mixing of materials in said mixer main body.

13. The mixer of claim 12, wherein said angle setting means includes means for setting said main body of said mixer to a tilt angle of 15 to 60°.

14. The mixer of claim 12, wherein said agitator means includes a driving shaft having a foremost part, agitator blades mounted one above the other to said shaft, and means for rotatably driving said shaft.

15. The mixer of claim 14, wherein said cracking and dispersing means comprises a rotor mounted to said foremost part of said shaft of said agitator means, and having a plurality of upstanding projections.

16. The mixer of claim 12, wherein said scraper is ring-shaped and includes elastic members contacting with said inner wall of said casing.

17. The mixer of claim 12, wherein said shaft of said agitator means and said scraper are revolved concentrically and individually with respect to each other, said scraper being revolved at a lower rotational speed than said shaft of said agitator means.

18. The mixer of claim 17, wherein said driving means of said shaft rotates said shaft at a speed of 300 to 10,000 rpm, and said driving means of said scraper rotates said scraper at a speed of 10 to 100 rpm.

* * * * *